US009156141B2

(12) United States Patent
Chang

(10) Patent No.: US 9,156,141 B2
(45) Date of Patent: Oct. 13, 2015

(54) ADAPTOR FOR WRENCH DEVICE

(71) Applicant: Hung Wen Chang, Taichung (TW)

(72) Inventor: Hung Wen Chang, Taichung (TW)

( * ) Notice: Subject to any disclaimer, the term of this patent is extended or adjusted under 35 U.S.C. 154(b) by 199 days.

(21) Appl. No.: 13/792,409

(22) Filed: Mar. 11, 2013

(65) Prior Publication Data

US 2014/0144295 A1 May 29, 2014

(30) Foreign Application Priority Data

Nov. 27, 2012 (TW) ..... 101222914 A

(51) Int. Cl.

| | |
|---|---|
| ***B25B 13/06*** | (2006.01) |
| ***B25B 13/04*** | (2006.01) |
| ***B25B 13/56*** | (2006.01) |
| ***B25B 23/00*** | (2006.01) |
| *B25B 13/00* | (2006.01) |
| *B25B 13/48* | (2006.01) |

(52) U.S. Cl.

CPC ..... *B25B 13/06* (2013.01); *B25B 13/04* (2013.01); *B25B 13/56* (2013.01); *B25B 23/0035* (2013.01); *B25B 13/005* (2013.01); *B25B 13/48* (2013.01)

(58) Field of Classification Search

CPC ..... B25B 13/06; B25B 13/56; B25B 13/04; B25B 13/48; B25B 13/005

USPC ..... 81/124.4, 121.1, 3.29, 177.85, 60, 63

See application file for complete search history.

(56) References Cited

U.S. PATENT DOCUMENTS

| | | | | |
|---|---|---|---|---|
| 2,869,410 | A * | 1/1959 | Prichard | 81/177.2 |
| 4,328,720 | A * | 5/1982 | Shiel | 81/63 |
| 4,535,658 | A * | 8/1985 | Molinari | 81/177.85 |
| 4,817,475 | A * | 4/1989 | Kelly et al. | 81/121.1 |
| 4,947,713 | A | 8/1990 | Arnold | |
| 5,626,062 | A * | 5/1997 | Colvin | 81/63.2 |
| D425,385 | S * | 5/2000 | Jarvis | D8/29 |
| 6,467,379 | B1 | 10/2002 | Wizman | |
| 6,622,598 | B2 | 9/2003 | Chang | |
| 6,647,831 | B2 * | 11/2003 | Hu | 81/60 |
| 7,000,504 | B2 * | 2/2006 | Chen | 81/60 |
| 7,096,766 | B2 * | 8/2006 | Hsieh | 81/124.4 |
| 7,104,163 | B2 * | 9/2006 | Hu | 81/124.3 |
| 8,459,151 | B2 * | 6/2013 | Wang et al. | 81/63.2 |
| 2002/0011135 | A1 * | 1/2002 | Hall | 81/124.4 |

* cited by examiner

*Primary Examiner* — Hadi Shakeri
*Assistant Examiner* — Danny Hong
(74) *Attorney, Agent, or Firm* — Charles E. Baxley

(57) ABSTRACT

A driving wrench device includes an adaptor for engaging with a non-circular compartment of a wrench member, the adaptor includes a non-circular outer peripheral portion for engaging with the non-circular compartment of the wrench member, and the adaptor includes an upper portion having an upper engaging hole, and a bottom portion having a bottom engaging hole communicating with the upper engaging hole of the adaptor, the engaging holes of the adaptor include an inner diameter different from each other for engaging with the fasteners or tool members of different outer diameters. The adaptor includes an outer notch for engaging with a retaining ring of the wrench member.

2 Claims, 4 Drawing Sheets

ADAPTOR FOR WRENCH DEVICE

BACKGROUND OF THE INVENTION

1. Field of the Invention

The present invention relates to a driving socket device or an adaptor, and more particularly to a driving socket device or an adaptor for attaching or mounting or securing a driving wrench device and including two engaging holes of different sizes or dimensions or inner diameters for receiving or engaging with the fasteners or other tool members of different sizes or dimensions or outer diameters.

2. Description of the Prior Art

Various kinds of typical driving socket devices or adaptors have been developed and provided for being attached or mounted or secured or coupled to the driving wrench devices and comprise an engaging hole formed therein for receiving or engaging with the fasteners or tool members and for selectively driving or rotating the fasteners or tool members.

For example, U.S. Pat. No. 4,947,713 to Arnold, U.S. Pat. No. 6,647,831 to Hu, and U.S. Pat. No. 7,000,504 to Chen disclose several of the typical driving socket devices or adaptors including an engaging hole formed therein for receiving or engaging with the fasteners or tool members and for selectively driving or rotating the fasteners or tool members.

However, the single engaging hole formed in the driving socket device or adaptor may only be used for receiving or engaging with the fastener or other tool member of one size or dimension or outer diameter, but may not be used for receiving or engaging with the fasteners or other tool members of the other or different sizes or dimensions or outer diameters.

U.S. Pat. No. 6,467,379 to Wizman, and U.S. Pat. No. 6,622,598 to Chang disclose the other typical driving socket devices or adaptors including an adjustable structure or configuration for receiving or engaging with the fasteners or other tool members of different sizes or dimensions or outer diameters.

However, the typical driving socket devices or adaptors includes a complicated structure or configuration that may not be easily and quickly made or manufactured and that should be made or manufactured with a greatly increased manufacturing cost and a complicated manufacturing procedure.

The present invention has arisen to mitigate and/or obviate the afore-described disadvantages of the conventional adaptors for driving wrench devices.

SUMMARY OF THE INVENTION

The primary objective of the present invention is to provide a driving socket device or an adaptor for attaching or mounting or securing a driving wrench device and including two engaging holes of different sizes or dimensions or inner diameters for receiving or engaging with the fasteners or other tool members of different sizes or dimensions or outer diameters.

In accordance with one aspect of the invention, there is provided a driving wrench device comprising an adaptor for engaging with a non-circular compartment of a wrench member, the adaptor including a non-circular outer peripheral portion for engaging with the non-circular compartment of the wrench member and for allowing the adaptor to be selectively rotated and driven by the wrench member, and the adaptor including an upper portion having a first engaging hole formed therein, and including a bottom portion having a second engaging hole formed therein and communicating with the first engaging hole of the adaptor, the first and the second engaging holes of the adaptor including an inner diameter different from each other for engaging with the fasteners or tool members of different outer diameters and for selectively driving or rotating the fasteners or tool members of different outer diameters.

The adaptor includes an outer peripheral stop extended radially and outwardly therefrom for engaging with the wrench member and for anchoring or retaining or positioning the adaptor to the wrench member. The adaptor includes an inner peripheral shoulder formed and defined between the first and the second engaging holes of the adaptor.

The adaptor includes one or more notches formed in the outer peripheral portion of the adaptor, and the wrench member includes a retaining ring for engaging with the notches of the adaptor and for anchoring the adaptor to the wrench member. The adaptor includes a tilted or inclined surface for forming and defining the respective notch of the adaptor and for facilitating the insertion or engagement of the retaining ring into the notches of the adaptor when the adaptor is engaged into the non-circular compartment of the wrench member.

The adaptor includes a chamfer formed in the bottom portion thereof for facilitating an engagement or insertion of the adaptor into the non-circular compartment of the wrench member, and for facilitating the insertion or engagement of the retaining ring into the notch of the adaptor when the adaptor is engaged into the non-circular compartment of the wrench member from the upper side or portion of the wrench member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 6:
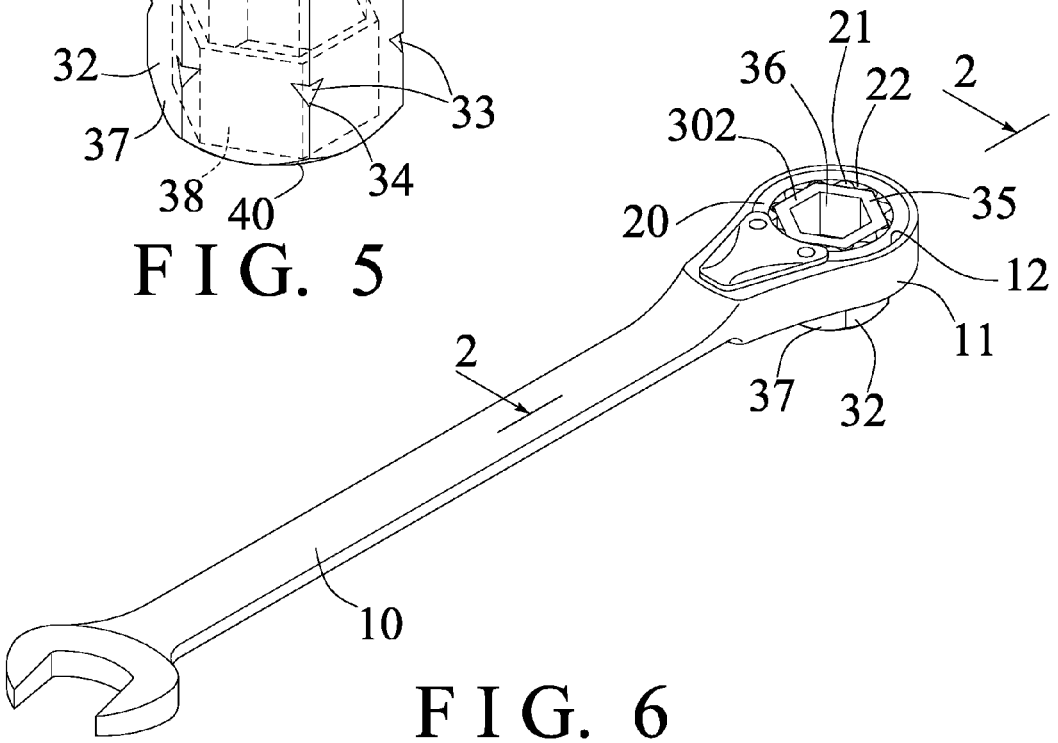
FIG. 6 is a further perspective view similar to FIG. 1, illustrating the operation of the adaptor as shown in FIG. 5.

Referring to the drawings, and initially to FIGS. 1-2 and 6-7, a driving wrench device 1 in accordance with the present invention comprises a wrench member 10 including a head 11 formed or provided in one end portion thereof and having a compartment or chamber 12 formed therein for receiving or engaging with a gear member 20, the gear member 20 includes a chamber or compartment 21, such as a non-circular compartment 21 formed therein for receiving or engaging with a driving socket device or adaptor 30 therein and arranged for allowing the adaptor 30 to be selectively pivoted or rotated or driven by the wrench member 10 with the gear member 20. The compartment 21 of the gear member 20 may include a wavy structure or configuration as shown in FIG. 6 having a number of teeth 22 formed therein, or the other non-circular cross section, such as square, hexagonal, octangular or the like.

Alternatively, the gear member 20 may be formed integral with the head 11 of the wrench member 10, and the wrench member 10 may include the non-circular compartment 21 or the teeth 22 directly formed in the head 11 thereof for receiving or engaging with the driving socket device or adaptor 30 and also for allowing the adaptor 30 to be selectively pivoted or rotated or driven by the wrench member 10 with the gear member 20. The wrench member 10 may further include a tongue or pawl (not illustrated) for engaging with the gear member 20 and for determining or controlling the driving direction of the adaptor 30 and/or the gear member 20 by or with the wrench member 10. The above-described structure or configuration for the gear member 20 and the head 11 of the wrench member 10 and the pawl (not illustrated) is typical and is not related to the present invention and will not be described in further details.

Figure 1:
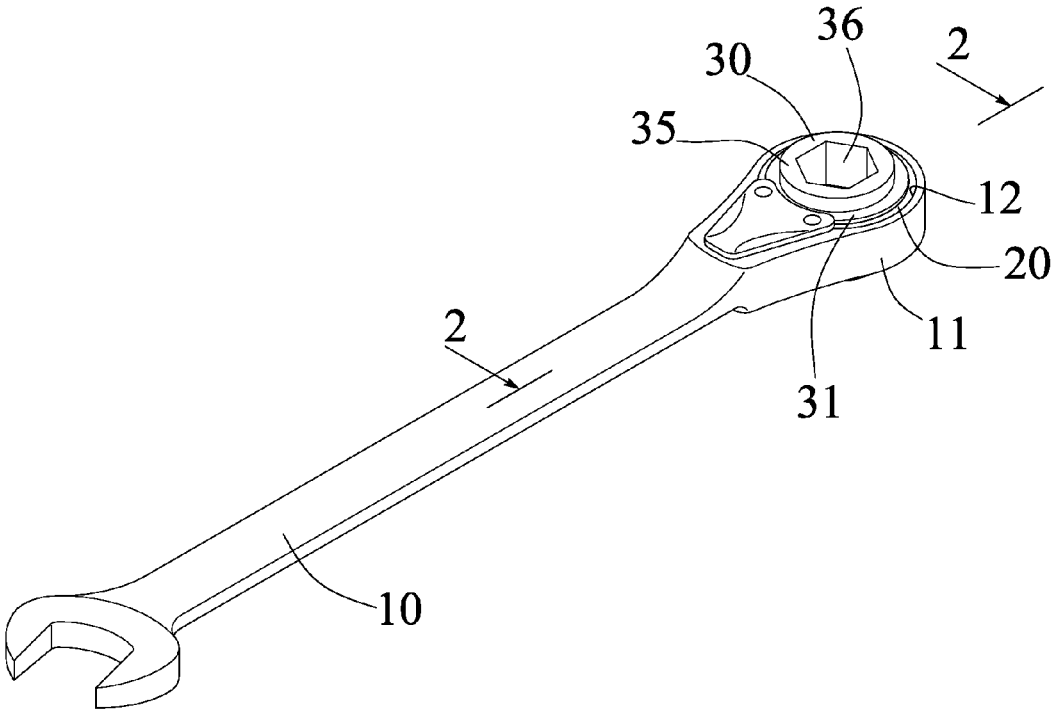
FIG. 1 is a perspective view of a driving wrench device including a driving socket device or adaptor in accordance with the present invention.
Figure 2:
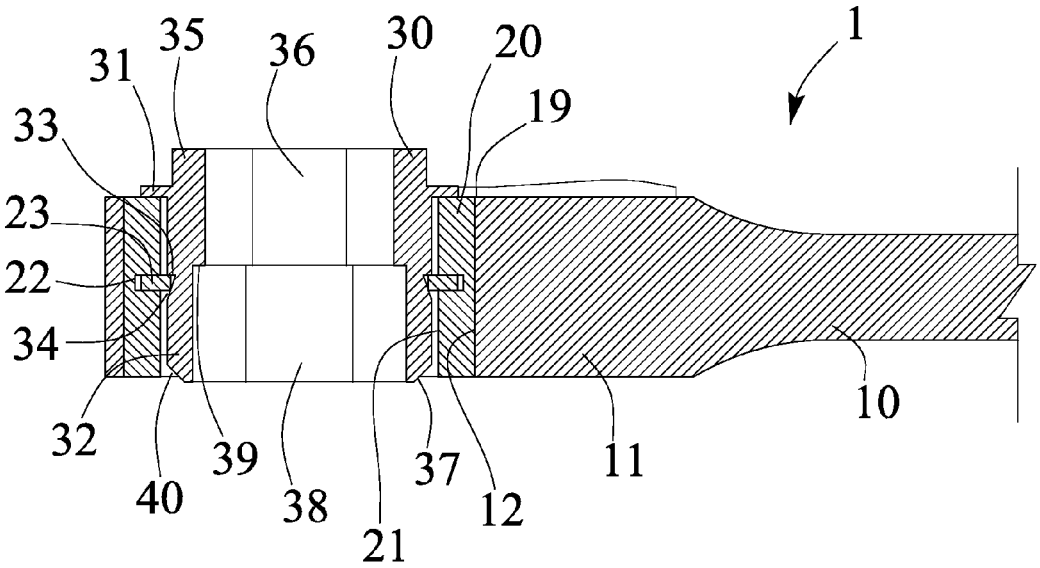
FIG. 2 is a partial cross sectional view of the driving wrench device, taken along lines 2-2 of FIG. 1.
Figure 3:
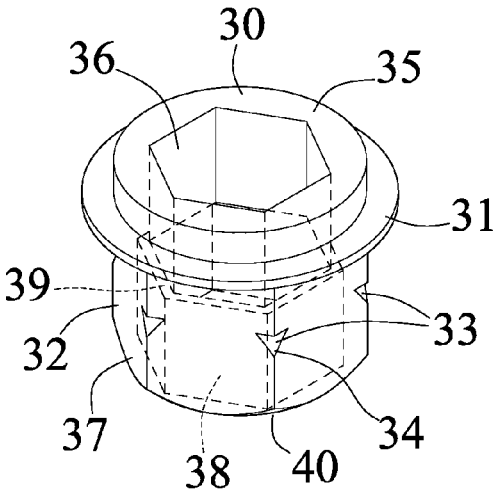
FIG. 3 is a perspective view of the adaptor.
Figure 7:
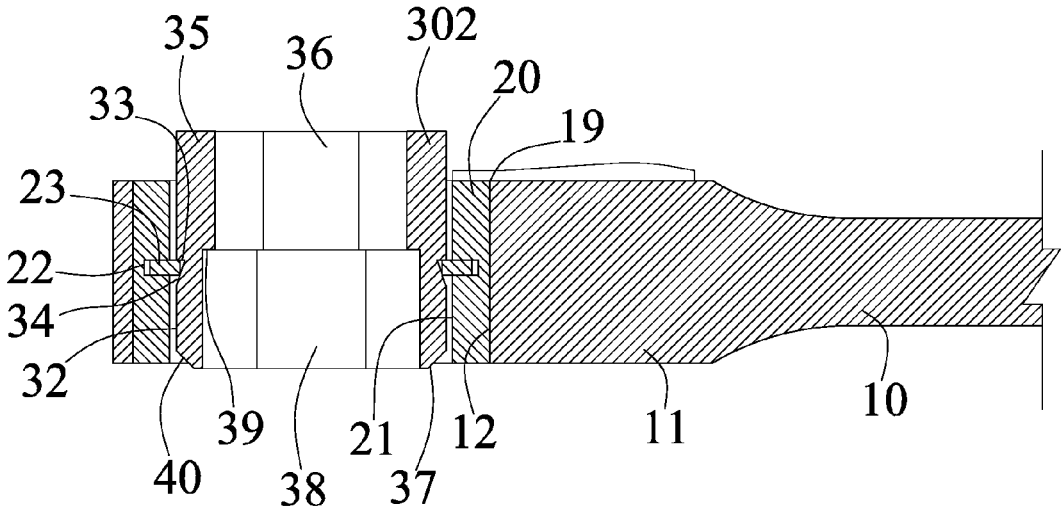
FIG. 7 is a partial cross sectional view of the driving wrench device, taken along lines 7-7 of FIG. 6.
Figure 8:
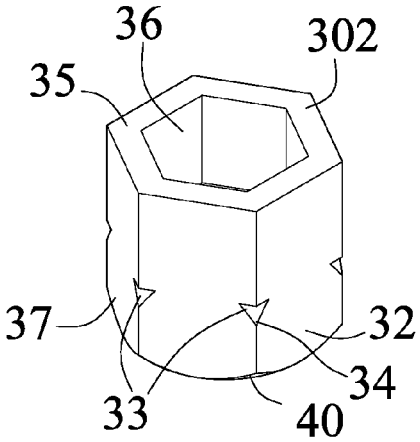
FIGS. 8, 9, 10 are upper perspective views similar to FIGS. 3-5, illustrating the still further arrangement of the adaptor.
Figure 9:
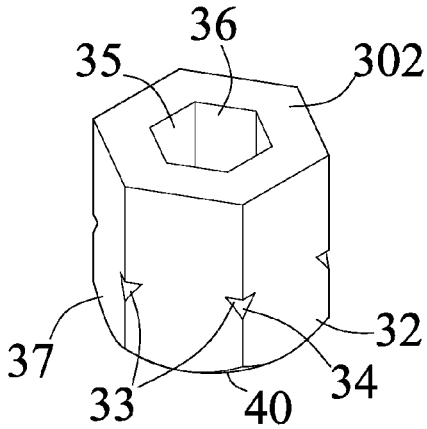
Figure 10:
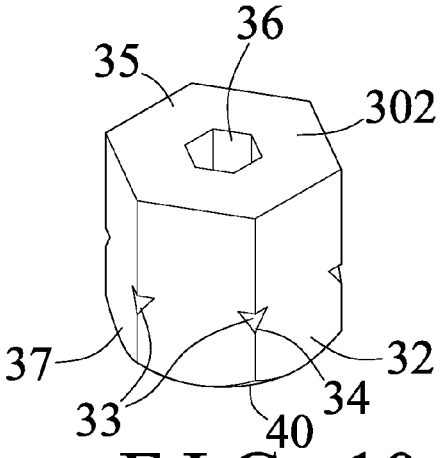
Figure 11:
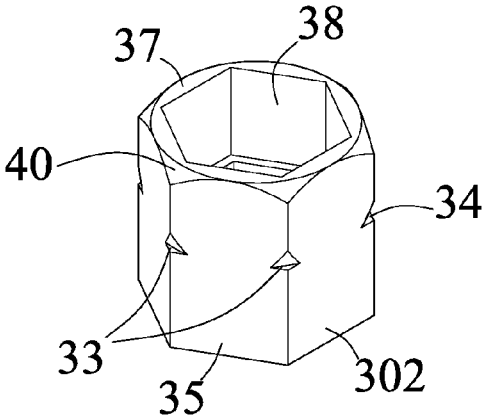
FIGS. 11, 12, 13 are bottom perspective views of the adaptors as shown in FIGS. 8, 9, 10 respectively.
Figure 12:
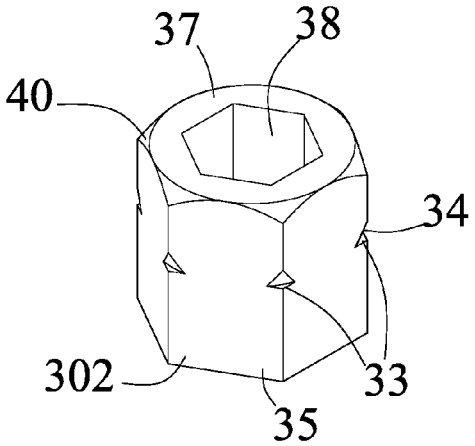
Figure 13:
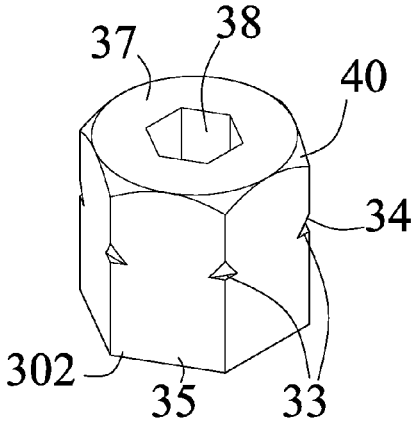

As shown in FIGS. 2 and 7, the head 11 of the wrench member 10 or the gear member 20 includes an inner peripheral groove 22 formed therein and communicating with the compartment 21 of the gear member 20 for receiving or engaging with a clamping or retaining ring 23 which is partially projected or extended into the compartment 21 of the gear member 20 for selectively engaging with the adaptor 30 and for anchoring or positioning or retaining or securing or refining the adaptor 30 in the compartment 21 of the gear member 20 and for preventing the adaptor 30 from being disengaged or separated from the gear member 20 and/or the head 11 of the wrench member 10 inadvertently. The adaptor 30 may include an outer peripheral flange or stop 31 extended radially and outwardly therefrom for contacting or engaging with the gear member 20 and/or the head 11 of the wrench member 10 and for further anchoring or positioning or retaining or securing the adaptor 30 to the gear member 20 and/or the head 11 of the wrench member 10.

Figure 17:
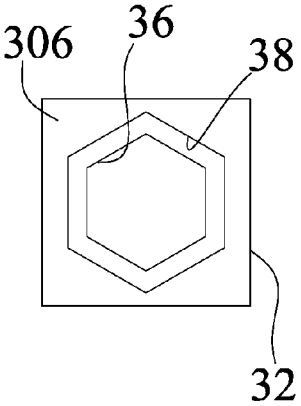
Figure 18:
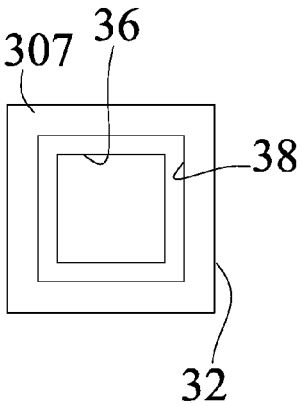

As shown in FIGS. 3-5 and 8-16, the adaptor 30 includes a non-circular, such as square (FIGS. 17-19), hexagonal (FIGS. 3-6, 8-16) or the like, outer peripheral surface or portion 32 formed or provided thereon for selectively engaging with the non-circular compartment 21 of the gear member 20 or of the wrench member 10 and thus for allowing the adaptor 30 to be selectively pivoted or rotated or driven by the wrench member 10 with the gear member 20. The adaptor 30 includes a number of recesses or depressions or notches 33 formed in the outer peripheral portion 32 thereof for selectively receiving or engaging with the retaining ring 23 and for further anchoring or positioning or retaining or securing the adaptor 30 to the gear member 20 and/or the head 11 of the wrench member 10 and for preventing the adaptor 30 from being disengaged or separated from the gear member 20 and/or the head 11 of the wrench member 10 inadvertently.

As shown in FIGS. 3, 5 and 8-13, and best shown in FIGS. 2 and 7, the adaptor 30 further includes a tilted or inclined surface 34 formed or provided in the respective notch 33 thereof, or may include a tilted or inclined surface 34 for forming or defining the respective notch 33 thereof and thus for allowing the retaining ring 23 to be easily and readily engaged into the notches 33 of the adaptor 30 when the adaptor 30 is engaged into the non-circular compartment 21 of the gear member 20 or of the wrench member 10 from the upper side or portion 19 of the wrench member 10 or of the gear member 20 (FIGS. 2 and 7), and also for allowing the adaptor 30 to be easily and readily and selectively disengaged from the gear member 20 and/or the head 11 of the wrench member 10 when required.

Figure 4:
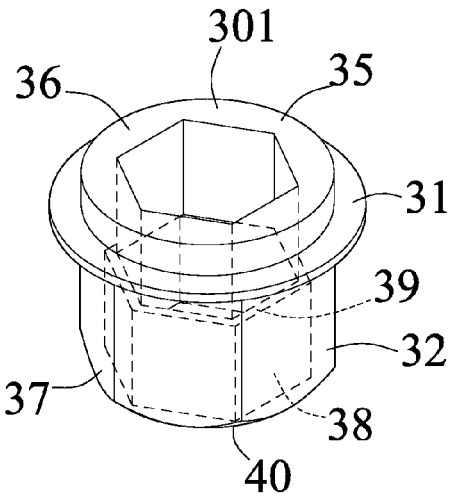
FIG. 4 is another perspective view similar to FIG. 3, illustrating the other arrangement of the adaptor.
Figure 5:
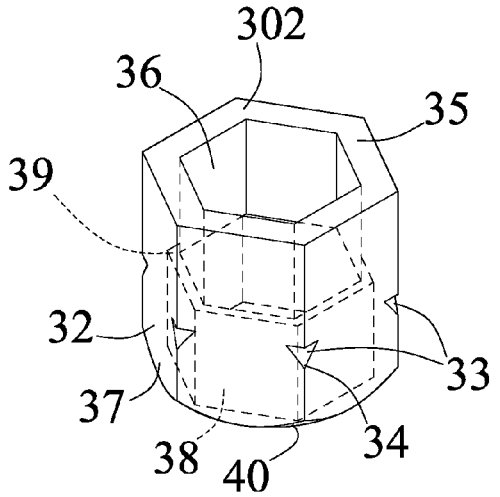
FIG. 5 is a further perspective view similar to FIGS. 3 and 4, illustrating the further arrangement of the adaptor.
Figure 14:
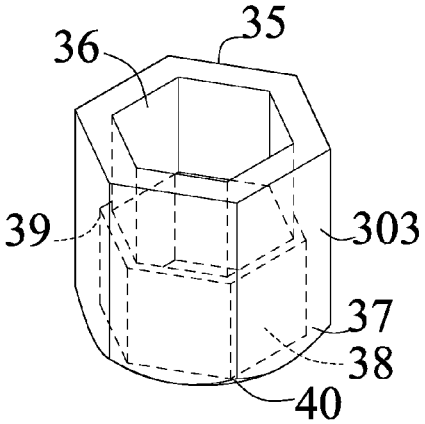
FIG. 14 is a still further perspective view similar to FIGS. 3-5 and 8-10, illustrating the still further arrangement of the adaptor.
Figure 15:
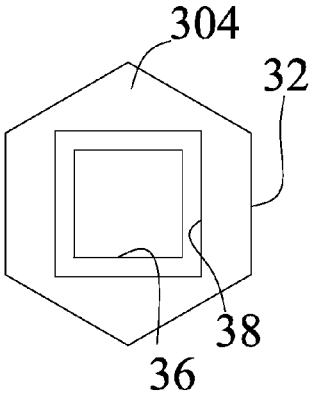
FIGS. 15, 16, 17, 18, and 19 are bottom plan schematic views illustrating the still further arrangement of the adaptor.

Alternatively, as shown in FIGS. 4 and 14, the adaptors 301, 303 may include no notches formed in the outer peripheral portion 32 thereof, and the adaptor 301 (FIG. 4) may be anchored or retained or positioned or secured to the gear member 20 and/or the head 11 of the wrench member 10 with the outer peripheral flange or stop 31 of the adaptor 301, and/or the gear member 20 and the adaptors 301, 303 may be made or manufactured with or of magnetic attractive materials for allowing the adaptors 301, 303 to be selectively anchored or retained or positioned or secured to the gear member 20 and/or the head 11 of the wrench member 10 with the magnetic attractive materials of the gear member 20 and the adaptors 301, 303.

Or, alternatively, as shown in FIGS. 5-13, the adaptors 302, 304, 305, 306, 307, 308 may include no outer peripheral flange or stop formed or provided thereon, and the adaptors 302 may be anchored or retained or positioned or secured to the gear member 20 and/or the head 11 of the wrench member 10 with the retaining ring 23 which is engageable with the notches 33 of the adaptors 302, and/or the adaptors 304, 305, 306, 307, 308 may also be made or manufactured with or of magnetic attractive materials for allowing the adaptors 304, 305, 306, 307, 308 to be selectively anchored or retained or positioned or secured to the gear member 20 and/or the head 11 of the wrench member 10 with the magnetic attractive materials of the gear member 20 and the adaptors 304, 305, 306, 307, 308.

Referring again to FIGS. 1-14, the adaptors 301, 302, 303 may include an upper portion 35 having a first non-circular engaging hole 36 formed or provided therein (FIGS. 1-19), and may include a bottom portion 37 having another or second non-circular engaging hole 38 formed or provided therein (FIGS. 2, 5, 7) and communicating with the non-circular engaging hole 36 that is formed or provided in the upper portion 35 thereof, in which the non-circular engaging holes 36, 38 of the adaptors 301, 302, 303 include an inner diameter different from each other for receiving or engaging with the fasteners or other tool members (not illustrated) of different sizes or dimensions or outer diameters, for example, the engaging holes 36 of the adaptors 301, 302, 303 include an inner diameter smaller than that of the engaging holes 38 of the adaptors 301, 302, 303 for forming or defining an inner peripheral shoulder 39 between the engaging holes 36, 38 of the adaptors 301, 302, 303.

Figure 16:
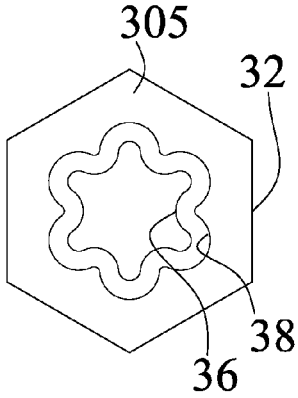
Figure 19:
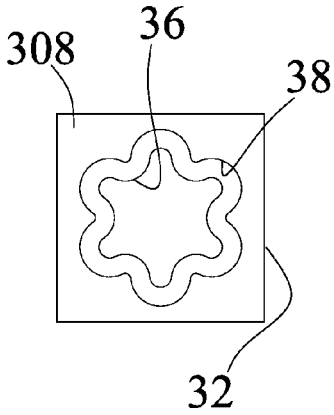

As best shown in FIGS. 2 and 7, the adaptor 30 further includes a cut off portion or rounded edge or chamfer 40 formed therein, such as formed in the outer peripheral portion 32 and/or the bottom portion 37 thereof for facilitating the insertion or engagement of the adaptor 30 into the compartment 21 of the gear member 20, and also for facilitating the insertion or engagement of the retaining ring 23 into the notches 33 of the adaptor 30 when the adaptor 30 is engaged into the non-circular compartment 21 of the gear member 20 or of the wrench member 10 from the upper side or portion 19 of the wrench member 10 or of the gear member 20. The adaptors 30, 301, 302, 303, 304, 305, 306, 307, 308 may include the engaging holes 36, 38 of the hexagonal cross section (FIGS. 1-14 and 17), or of the square cross section (FIGS. 15, 18), or of the wavy structure or configuration as shown in FIGS. 16 and 19.

In operation, as shown in FIGS. 1-2 and 6-7, the adaptors 30, 301, 302, 303, 304, 305, 306, 307, 308 may be changeably and selectively engaged into the non-circular compartment 21 of the gear member 20 or of the wrench member 10 and anchored or retained or positioned or secured to the gear member 20 and/or the head 11 of the wrench member 10 with the magnetic attractive materials of the gear member 20 and the adaptors 301, 303, the outer peripheral flange or stop 31 of the adaptor 30, 301, and/or the retaining ring 23, without additional tool members or devices, and may be easily and readily and selectively disengaged from the gear member 20 and/or the head 11 of the wrench member 10 when required, and the engaging holes 36, 38 of the adaptors 30, 301, 302, 303, 304, 305, 306, 307, 308 of different sizes or dimensions or inner diameters may be used for receiving or engaging with the fasteners or other tool members of different sizes or dimensions or outer diameters.

Accordingly, the adaptor in accordance with the present invention may be provided for attaching or mounting or securing a driving wrench device and includes two engaging holes of different sizes or dimensions or inner diameters for receiving or engaging with the fasteners or other tool members of different sizes or dimensions or outer diameters.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving wrench device comprising:

a wrench member including a non-circular compartment formed therein, an adaptor for engaging with said non-circular compartment of said wrench member, said adaptor including a non-circular outer peripheral portion for engaging with the non-circular compartment of the wrench member and for allowing said adaptor to be selectively rotated and driven by the wrench member, said adaptor including an upper portion having a first non-circular engaging hole formed therein, and including a bottom portion having a second non-circular engaging hole formed therein and communicating with said first non-circular engaging hole of said adaptor, said first and said second non-circular engaging holes of said adaptor including an inner diameter different from each other, said adaptor including an inner peripheral shoulder formed and defined between said first and said second non-circular engaging holes of said adaptor, said adaptor including a notch formed in said outer peripheral portion of said adaptor, and said adaptor including an inclined surface for forming and defining said notch of said adaptor, and said adaptor including a chamfer formed in said bottom portion of said adaptor for facilitating an engagement of said adaptor into the non-circular compartment of the wrench member, and said wrench member including a retaining ring for engaging with said notch of said adaptor and for anchoring said adaptor to the wrench member.

2. The adaptor as claimed in claim 1, wherein said adaptor includes an outer peripheral stop extended radially and outwardly therefrom for engaging with the wrench member and for anchoring said adaptor to the wrench member.

* * * * *